US009666957B2

(12) United States Patent
Endo

(10) Patent No.: US 9,666,957 B2
(45) Date of Patent: May 30, 2017

(54) CONNECTOR TERMINAL

(71) Applicant: DAI-ICHI SEIKO CO., LTD., Kyoto (JP)

(72) Inventor: Takayoshi Endo, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/853,391

(22) Filed: Sep. 14, 2015

(65) Prior Publication Data

US 2016/0087353 A1 Mar. 24, 2016

(30) Foreign Application Priority Data

Sep. 19, 2014 (JP) ..... 2014-191627

(51) Int. Cl.
*H01R 4/48* (2006.01)
*H01R 13/11* (2006.01)
(Continued)

(52) U.S. Cl.
CPC ..... *H01R 4/48* (2013.01); *H01R 13/113* (2013.01); *H01R 13/187* (2013.01); *H01R 13/2492* (2013.01)

(58) Field of Classification Search
CPC ..... H01R 4/48; H01R 13/04; H01R 13/05; H01R 13/052; H01R 13/187;
(Continued)

(56) References Cited

U.S. PATENT DOCUMENTS 2,921,287 A * 1/1960 Anderson ..... H01R 13/115 439/849
3,320,574 A * 5/1967 Tuchel ..... H01R 4/188 439/745
(Continued)

FOREIGN PATENT DOCUMENTS

JP 2006172877 6/2006 ..... H01R 13/115
JP 2007018803 1/2007 ..... H01R 24/00
(Continued)

OTHER PUBLICATIONS

EPO Translation of JP 2009-252526 A, dated Sep. 16, 2016, pp. 1-21.*
(Continued)

*Primary Examiner* — Tulsidas C Patel
*Assistant Examiner* — Travis Chambers
(74) *Attorney, Agent, or Firm* — Hayes Soloway P.C.

(57) ABSTRACT

The connector terminal includes a first connector terminal and a second connector terminal to be fit into the first connector terminal, the first connector terminal including a flat spring making contact with a certain area of the second connector terminal, the certain area including a free end of the second connector terminal, and a terminal body including a pair of sidewalls between which the flat spring is disposed, the second connector terminal being formed in the certain area with two or more first projections each extending in a first direction in which the second connector terminal is fit into the first connector terminal, at least two first projections among the first projections making contact with the flat spring between the sidewalls.

13 Claims, 10 Drawing Sheets

(51) Int. Cl.
*H01R 13/187* (2006.01)
*H01R 13/24* (2006.01)

(58) Field of Classification Search
CPC .. H01R 13/703; H01R 11/282; H01R 13/113; H01R 13/2492
USPC ..... 439/816, 842, 843, 845, 849, 850, 889
See application file for complete search history.

(56) References Cited

U.S. PATENT DOCUMENTS 3,422,395 A * 1/1969 Fisher ..... H01R 13/115 439/884
3,550,069 A * 12/1970 Teagno ..... H01R 13/115 439/849
3,644,872 A * 2/1972 Russo, Jr. ..... H01R 13/115 439/849
4,691,981 A * 9/1987 Coldren ..... H01R 13/05 439/816
4,764,133 A * 8/1988 Kaneko ..... H01R 13/04 439/845
4,778,231 A * 10/1988 Seidler ..... H01R 13/193 439/295
4,992,064 A 2/1991 Steinhardt et al. ..... 439/845
5,135,414 A * 8/1992 van Dijk ..... H01R 13/04 439/660
5,201,668 A * 4/1993 Endo ..... H01R 29/00 439/189
5,281,178 A * 1/1994 Biscorner ..... H01R 13/052 439/845
5,540,603 A * 7/1996 Fujiwara ..... H01R 13/11 439/839
5,591,054 A * 1/1997 Okada ..... H01R 13/04 439/884
5,639,270 A * 6/1997 Barbieri ..... H01R 13/20 439/849
5,681,192 A * 10/1997 Kobayashi ..... H01R 13/055 439/884
5,775,963 A * 7/1998 Byfield, Jr. ..... H01R 13/04 439/884
5,989,053 A * 11/1999 Wheeler ..... H01R 13/04 439/387
6,056,604 A * 5/2000 Roy ..... H01R 13/187 439/845
6,068,526 A * 5/2000 Nottrott ..... H01R 13/18 439/845
6,254,702 B1 * 7/2001 Hana ..... C22C 9/06 148/433
6,293,831 B1 * 9/2001 Yamatani ..... H01R 13/115 439/849
6,331,742 B1 * 12/2001 Renkes ..... H01R 13/20 310/68 C
6,402,575 B1 * 6/2002 Suzuki ..... H01R 13/04 439/866
6,464,548 B2 * 10/2002 Saito ..... H01R 13/055 439/843
6,568,955 B2 * 5/2003 Hotea ..... H01R 12/79 439/260
6,790,106 B2 * 9/2004 Ito ..... H01R 43/16 439/866
7,775,840 B2 * 8/2010 Matsumoto ..... H01R 13/113 439/843
7,845,993 B2 * 12/2010 Falchetti ..... H01R 13/113 439/843
8,206,187 B2 * 6/2012 Nakamura ..... H01R 13/055 439/852
8,360,812 B2 * 1/2013 Osvatic ..... H01R 13/055 439/819
8,827,754 B2 * 9/2014 Lee ..... H01R 13/113 439/843
8,992,269 B2 * 3/2015 Salzmann ..... H01R 4/48 439/828
9,011,186 B2 * 4/2015 Wirth ..... H01R 13/112 439/843
9,022,801 B2 * 5/2015 Endo ..... H01R 13/533 439/527
9,054,438 B2 * 6/2015 Endo ..... H01R 12/91
9,270,043 B2 * 2/2016 Kobayashi ..... H01R 13/04
2002/0025733 A1 * 2/2002 Saito ..... H01R 13/055 439/845
2006/0128233 A1 * 6/2006 Matsuura ..... H01R 13/20 439/845
2006/0252294 A1 * 11/2006 Cvasa ..... H01R 13/187 439/252
2008/0146091 A1 * 6/2008 Tyler ..... H01R 13/03 439/843
2012/0156947 A1 * 6/2012 Tyler ..... H01R 13/113 439/842
2014/0248809 A1 * 9/2014 Onodera ..... H01R 13/03 439/884
2014/0322992 A1 * 10/2014 Nakamura ..... H01R 13/111 439/862
2014/0357138 A1 * 12/2014 Nakamura ..... H01R 13/113 439/884
2015/0180151 A1 * 6/2015 Sawada ..... H01R 13/03 439/866

FOREIGN PATENT DOCUMENTS

JP 2007141769 6/2007 ..... H01R 13/11
JP 2009252526 10/2009 ..... H01R 13/04
JP 2009252526 A * 10/2009 ..... H01R 13/04

OTHER PUBLICATIONS

German Office Action (with translation) issued in application No. 10 2015 217 777.7, dated May 31, 2016 (7 pgs).
Japanese Office Action (with translation) issued in application No. 2014-191627, dated Apr. 22, 2015 (6 pgs).

* cited by examiner

CONNECTOR TERMINAL

BACKGROUND OF THE INVENTION

Field of the Invention

The invention relates to a connector terminal including a female connector terminal, and a male connector terminal to be fit into the female connector terminal.

Description of the Related Art

A male connector terminal of a male electric connector is fit into a female connector terminal of a female electric connector to thereby electrically connect with the same. A female connector terminal is designed to include a sheath portion into which a tab portion of a male connector terminal which is in the form of a needle. Being inserted into a sheath portion, a tab portion of a male connector terminal makes contact with a flat spring housed in the sheath portion.

When a tab portion is inserted into or pulled out of a sheath portion, the tab portion slides relative to a flat spring. For instance, a tab portion makes slide movement at a flat contact surface thereof with a flat contact surface of the flat spring, resulting in generation of much friction. Since much friction is generated in an electric connector including a large number of terminals, a tab portion has to be inserted into or pulled out of a sheath portion with excessive force. Consequently, there is accompanied with difficulty when a male electric connector and a female electric connector are fit into or pulled out of each other. Furthermore, since a tap portion and a flat spring slide each other through contact surfaces thereof, the contact surfaces of them might be shaved.

In order to solve this problem, Japanese Patent Application Publication No. 2007-18803 suggested a connector in which the contact surfaces are difficult to be shaved, maintaining sufficient reliability to electrical contact between male and female connector terminals.

FIG. 15 illustrates a part of a connector 1010 suggested in the above-identified Publication.

The illustrated connector 1010 includes a male terminal 1022, and a female terminal 1014 into which the male terminal 1022 is inserted. The male terminal 1022 has a wavy cross-section when viewed in a direction in which the male terminal 1022 is inserted into the female terminal 1014. The female terminal 1014 is forced toward the male terminal 1022 to thereby make contact with the male terminal 1022 at two points. The connector 1010 having the structure as mentioned above is not accompanied with contact defective between the female terminal 1014 and the male terminal 1022, even if the female terminal 1014 were not forced toward the male terminal 1022 with excessive force.

In the connector 1010 illustrated in FIG. 15, since the male terminal 1022 is wavy in the form, the male terminal 1022 makes contact with the female terminal 1014 at two points.

However, if the male terminal 1022 horizontally deviates relative to the female terminal 1014, projecting portions of the waves of the male terminal 1022 are also deviated, resulting in that only one projecting portion of the male terminal 1022 makes contact with the female terminal 1014. Thus, it is not possible to keep stability in contact between the male terminal 1022 and the female terminal 1014, and hence, contact reliability cannot be ensured between the male terminal 1022 and the female terminal 1014.

SUMMARY OF THE INVENTION

In view of the above-mentioned problems in the conventional connector, it is an object of the present invention to provide a connector terminal capable of reducing a force with which connector terminals are fit into or pulled out of each other, and enhancing reliability to contact between connector terminals.

In one aspect of the present invention, there is provided a connector terminal including a first connector terminal and a second connector terminal to be fit into the first connector terminal, the first connector terminal including a flat spring making contact with a certain area of the second connector terminal, the certain area including a free end of the second connector terminal, and a terminal body including a pair of sidewalls between which the flat spring is disposed, the second connector terminal having a rectangular cross-section, the second connector terminal including two or more first projections in the certain area on one of two surfaces thereof facing each other, the two or more first projections each extending in a first direction in which the second connector terminal is fit into the first connector terminal, at least two first projections among the first projections making contact with the flat spring between the sidewalls.

In the connector terminal in accordance with the present invention, the second connector terminal includes in the certain area at least two first projections each extending in a first direction in which the second connector terminal is fit into the first connector terminal. Accordingly, it is possible to reduce a force necessary for inserting the second connector terminal into and pull the second connector terminal out of the first connector terminal. Furthermore, since at least two first projections keep in contact with the flat spring, the first and second connector terminals are able to keep in stable contact with each other even if the certain area of the second connector terminal moves in a sheath portion between the sidewalls.

It is preferable that the terminal body includes a ceiling portion and a floor portion each connecting the sidewalls to each other, the second connector terminal including in the certain area at least one second projection making contact with the ceiling portion and extending in the first direction, the second projection being formed on the other surface of the two surfaces.

By designing the second connector terminal to make contact at the certain area thereof not only with the flat spring, but also with a ceiling portion, a contact area at which the second connector terminal makes contact with the first connector terminal is increased, and accordingly, a force necessary for inserting the second connector terminal into and pulling the second connector terminal out of the first connector terminal is increased. However, since the second connector terminal is formed in the certain area with the second projection on a surface through which the second connector terminal makes contact with the ceiling, it is possible to reduce a force necessary for inserting the second connector terminal into and pulling the second connector terminal out of the first connector terminal.

It is preferable that the flat spring includes an expanded portion making contact with the at least two first projections.

By designing the flat spring to include an expanded portion, the number of the first projections making contact with the flat spring is smaller than the number of the first projections making contact with a flat spring including no expanded portions, and hence, it is possible to reduce a force necessary for inserting the second connector terminal into and pulling the second connector terminal out of the first connector terminal, maintaining stable contact between the second connector terminal and the flat spring.

It is preferable that the flat spring includes a central area expanding in an arcuate form, the expanded portion being formed in the central area.

Being inserting into the first connector terminal, the second connector terminal can make contact at the certain area with the expanded portion being formed in the arcuate central area.

It is preferable that the flat spring includes a plurality of expanded portions making contact with the at least two first projections, the expanded portions being arranged in a width-wise direction of the flat spring.

By supporting the second connector terminal at the certain area with a plurality of expanded portions, it is possible to enhance stability in contact between the second connector terminal and the flat spring.

It is preferable that each of the expanded portions makes contact with the at least two first projections.

By designing each of the expanded portions to make contact with the at least two first projections, it is possible to further enhance stability in contact between the second connector terminal and the flat spring.

It is preferable that each of the first projections has an arcuate cross-section in a direction perpendicular to the first direction.

By designing each of the first projections to have an arcuate cross-section, the flat spring is hardly damaged when the second connector terminal is inserted into the first connector terminal.

For instance, the first projections can be formed by pressing.

In the fabrication of the second connector terminal from a single metal sheet, the first projections can be readily formed by pressing the metal sheet.

It is preferable that a distance between the at least two first projections is equal to a distance between the certain area and one of the sidewalls, the latter distance being to be measured when the certain area is disposed at a center of the flat spring.

It is preferable that a distance between the at least two first projections is equal to both a distance between the certain area and one of the sidewalls and a distance between the certain area and the other of the sidewalls, the last two distances being to be measured when the certain area is disposed at a center of the flat spring.

It is preferable that the second connector terminal includes three or more first projections, a distance between the first projections located adjacent to each other being equal to each other.

It is preferable that each of the first projections disposed at opposite ends in a width-wise direction of the second connector terminal has an inclined surface facing outwardly.

It is preferable that the first projections disposed at opposite ends in a width-wise direction of the second connector terminal are arranged to be located not to make contact with the flat spring even if the second connector terminal moves relative to the flat spring in a width-wise direction thereof.

The advantages obtained by the aforementioned present invention will be described hereinbelow.

In the connector terminal in accordance with the present invention, the flat spring always makes contact with at least two first projections formed on the second connector terminal in the certain area. Accordingly, it is possible to reduce a force necessary for inserting the second connector terminal into and pulling the second connector terminal out of the first connector terminal, and to maintain stable contact between the second connector terminal and the flat spring. Thus, it is possible to enhance reliability to electrical contact between the first and second connector terminals with the above-mentioned force being reduced.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

[First Embodiment]

A connector terminal in accordance with a first embodiment of the present invention is explained hereinbelow with reference to drawings.

In the specification, a wording "front" refers to a side at which male and female connectors are fit into each other, and a wording "rear" refers to the other side.

Figure 1:
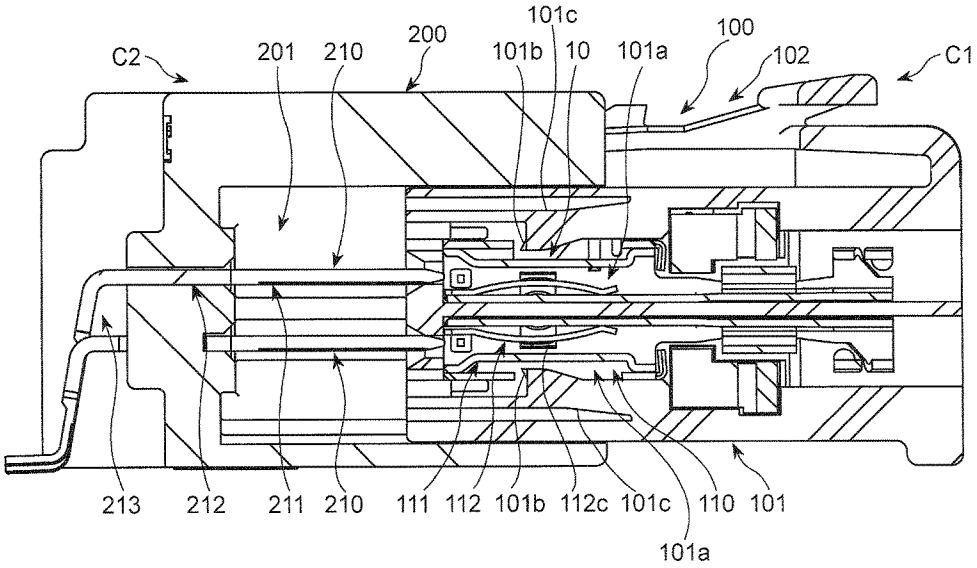
FIG. 1 is a cross-sectional view of the connector terminal in accordance with the first embodiment, including the female and male electric connector.

The connector terminal in accordance with the first embodiment includes a female connector terminal 110 of a female electric connector C1, and a male connector terminal 210 of a male electric connector C2, as illustrated in FIG. 1.

The female electric connector C1 includes a female housing 100 formed by a molding injection process, and the female connector terminal 110 into which a male connector terminal 210 of the male electric connector C2 is inserted.

The female housing 100 includes a housing body 101, and a lock arm 102. The housing body 101 is in the form of a rectangular parallelepiped, and is formed with six terminal housings 101*a* arranged vertically in two rows each including three terminal housings 101*a* in facing relation. The terminal housings 101*a* extend in a front-rear direction.

The housing body 101 is formed, at a ceiling thereof, with a stopper 101*c* including a lance 101*b* to be engaged with a female connector terminal 110 inserted into the terminal housing 101*a* through a rea of the housing body 101, to thereby prevent the female connector terminal 110 from being pulled out of the housing body 101.

Figure 2:
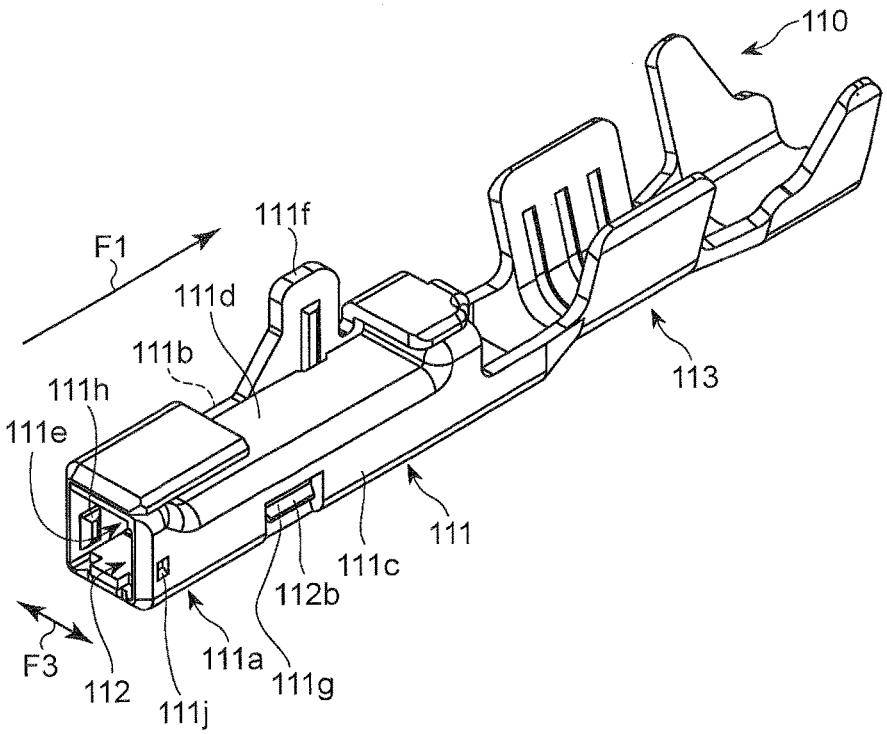
FIG. 2 is a perspective view of the female connector terminal of the female electric connector illustrated in FIG. 1.

As illustrated in FIG. 2, the female connector terminal 110 includes a sheath portion 111 as a female terminal body to be fit into the female housing 100 of the female electric connector C1, a flat spring 112 housed in the sheath portion 111 in such a condition that the flat spring 112 makes electrical contact with the sheath portion 111, and a bundling section 113 located at a rear of the sheath portion 111 for fixing a cable (not illustrated) therein in a compressed condition.

The sheath portion 111, the flat spring 112, and the bundling section 113 can be integrally formed by bending an electrically conductive metal sheet. In the female connector terminal 110 in the first embodiment, the flat spring 112 and the sheath portion 111 are fabricated as separate parts.

The sheath portion 111 includes a floor portion 111*a*, a pair of sidewalls 111*b* and 111*c* facing each other such that the flat spring 112 is disposed therebetween, and a ceiling portion 111*d*. The sheath portion 111 is fabricated to be hollow and to have a rectangular cross-section by punching a metal sheet and bending the sidewalls 11*b* and 111*c* and the ceiling portion 111*d* to thereby define an opening 111*e*.

The floor portion 111*a* and the ceiling portion 111*d* connect the sidewalls 111*b* and 111*c* to each other to thereby define a space in which the flat spring 112 can be disposed, and into which a later-mentioned tab portion of the male connector terminal 210 is inserted to make contact with the flat spring 112.

A stabilizer 111*f* stands on and extends outwardly from the sidewall 111*b* for preventing the female connector terminal 110 from being inserted into the female housing 100 upside down, and further, for keeping the posture of the female connector terminal 110 stable after the female connector terminal 110 has been inserted into the female housing 100.

Each of the sidewalls 111*b* and 111*c* is formed with a cut-out 111*g* into which each of ear portions 112*b* of the flat spring 112 is fit.

Each of the sidewalls 111*b* and 111*c* is formed with a projection 111*h* in order to ensure a later-mentioned tab portion of the male connector terminal 210 to be located within a width of the flat spring 112 when the male connector terminal 210 is inserted into the sheath portion 111. Each of the projections 111*h* projects inwardly of the sheath portion 111 by forming a recess 111*j* at an outer surface of each of the sidewalls 111*b* and 111*c*.

Figure 5:
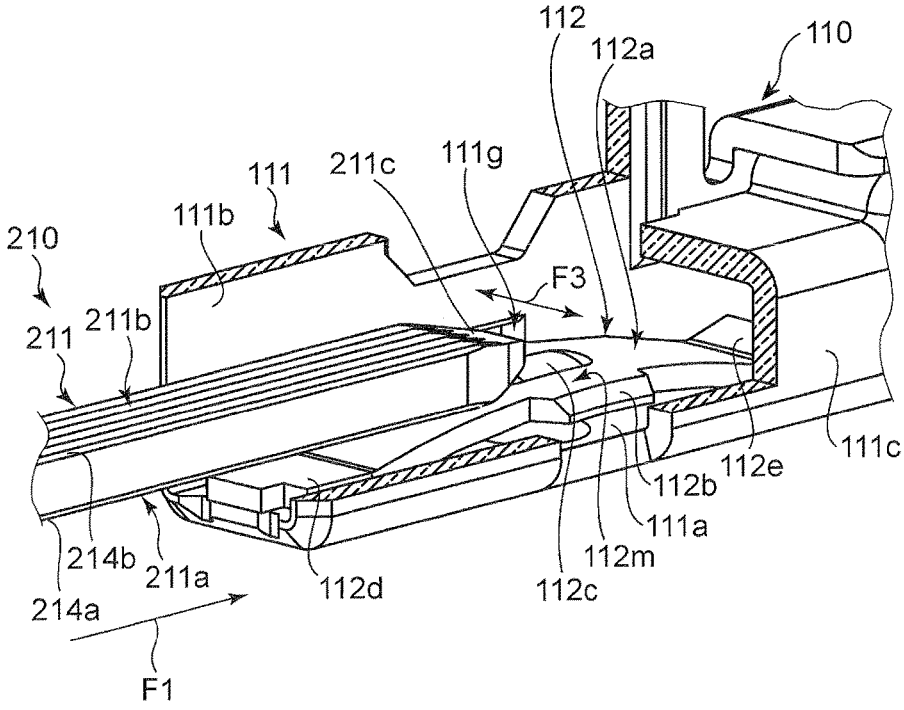
FIG. 5 is a perspective view with a portion of a sheath portion being cut, illustrating that the male connector terminal makes contact at the certain area with an expanded portion of the flat spring when the male connector terminal is inserted into a sheath portion of the female connector terminal.

As illustrated in FIGS. 2 and 5, the flat spring 112 is comprised of a resilient contact piece, and has a central area 112*m* located centrally in a direction F1 in which the tab portion of the male connector terminal 210 is inserted into the sheath portion 111, that is, a length-wise direction of the flat spring 111 and the sheath portion 111. The central area 112*m* is designed to be arcuate, that is, to be expanded towards the ceiling portion 111*d*. The flat spring 112 is disposed along the floor portion 111*a* in the length-wise direction of the sheath portion 111.

As illustrated in FIG. 5, the flat spring 112 includes a spring body 112*a* being arcuate like a bow, two ear portions 112*b* outwardly extending from opposite side edges of the central area 112*m* located centrally of the spring body 112*a*, and an expanded portion 112*c* located in the central area 112*m* in which the ear portions 112*b* are formed, and acting as a contact portion to make contact with the male contact terminal 210.

The flat spring 112 is supported on the floor portion 111*a* of the sheath portion 111 at a front end 112*d* and a rear end 112*e* of the flat spring 112. The ear portions 112*b* located in the central area 112*m* are fit into the cut-outs 111*g* formed at the sidewalls 111*b* and 111*c* to thereby prevent the flat spring 111 from moving toward the ceiling portion 111*d*. Thus, though the front end 112*d* and the rear end 112*e* are free ends, the flat spring 112 can act as an arcuate flat spring.

The expanded portion 112*c* is formed to have an expanded arcuate surface by embossing the spring body 112 at a surface opposite to a surface at which the flat spring 112 makes contact with the male connector terminal 210. Since the expanded portion 112*c* is formed centrally in a with-wise direction F3 of the flat spring 112, the expanded portion 112*c* is located at a center of a width of the floor portion 111*a* or the ceiling portion 111*d* of the sheath portion 111.

When viewed from the ceiling portion 111*d*, the expanded portion 112*c* is formed arcuate at opposite ends (front and rear ends) thereof in the direction F1. The central area 112*m* disposed between the front and rear ends of the expanded portion 112*c* is formed to be linear to connect the arcuate front and rear ends to each other. The expanded portion 112*c* is longer in a direction in parallel with the direction F1 (that is, a length-wise direction of the flat spring 112) than in a direction perpendicular to the direction F1 (that is, a width-wide direction F3 of the flat spring 112).

Furthermore, the front and rear ends of the expanded portion 112*c* are formed arcuate to upwardly incline toward a center from a periphery of the arcuate shape thereof. The expanded portion 112*c* centrally has an arcuate cross-section along the width-wise direction F3 of the flat spring 112.

In the fabrication of the female connector terminal 110, a single metal sheet is punched into a two-dimensional shape or a development of the female connector terminal 110.

Then, the cut-outs 111*g* are formed in a developed portion of the sheath portion 111. Then, the flat spring 112 is put on the floor portion 111*a*.

Then, the sidewalls 111*b* and 111*c* are caused to stand on the floor portion 111*a* such that the ear portions 1112*b* of the flat spring 112 are fit into the cut-outs 111*g*.

Then, the sidewall 111*c* is bent above the floor portion 111*a* to thereby define the ceiling portion 111*d*, and further partially bent toward the ceiling portion 111*d* except an area which will be formed as a recess with which the lance 101*b* is engaged.

Thus, the female connector terminal 110 is completed.

As illustrated in FIG. 1, the male electric connector C2 includes a male housing 200 fabricated by a molding injection process, and a male connector terminal 210 to be inserted into the female connector terminal 110.

The male housing 200 is in the form of a rectangular parallelepiped, and is formed with a space 201 into which the male connector terminals 210 project and the female housing 100 is fit.

The male connector terminals 210 are housed in the space 201 in vertical two rows each including three columns, in correspondence with the female connector terminals 110.

Figure 3:
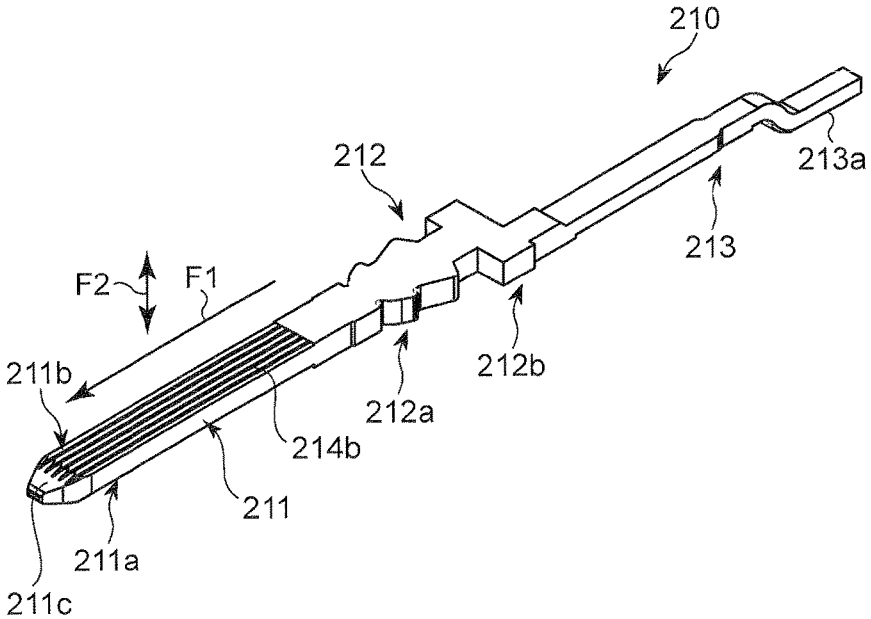
FIG. 3 is a perspective view of the male connector terminal of the male electric connector illustrated in FIG. 1.

As illustrated in FIG. 3, the male connector terminal 210 includes a needle-shaped tab portion 211, an insertion portion 212 through which the male connector terminal 210 is inserted into the male housing 200, and an outer lead portion 213 making mechanical and electrical contact with a metal pad of a printed wiring board (not illustrated).

The tab portion 211 is inserted into the female connector terminal 110 of the female electric connector C2 to thereby make mechanical and electrical contact with the female connector terminal 110. The tab portion 211 has a first contact surface 211*a* at which the male connector terminal 210 makes contact with the flat spring 112 of the female connector terminal 110, and a second contact surface 211*b*, opposite to the first contact surface 211*a*, making contact with the ceiling portion 111*d* of the sheath portion 111. Each of the first and second contact surfaces 211*a* and 211*b* is formed with a plurality of first projections 214*a* and second projections 214*b*, respectively, each extending in the direction F1 in which the male connector terminal 210 is inserted into the female connector terminal 110.

Each of the first and second projections 214*a* and 214*b* linearly extend toward the outer lead portion 213 from a tapered portion 211*c* formed at a distal end of the tab portion 211. Each of the first and second projections 214*a* and 214*b* is designed to have an arcuate cross-section in a thickness-wise direction F2 perpendicular to the direction F1. In the first embodiment, each of the first and second projections 214*a* and 214*b* has a semicircular cross-section. The first and second projections 214*a* and 214*b* are equally spaced away from adjacent ones in the width-wise direction F3. The tab portion 211 in the first embodiment is designed to have six first and second projections 214*a* and 214*b* at each of the first and second contact surfaces 211*a* and 211*b*.

The insertion portion 211 includes an engagement portion 212*a* outwardly gradually protruding in the width-wise direction F3 of the male connector terminal 210, and a shoulder portion 212*b* at which the male connector terminal 210 is pushed for inserting the male connector terminal 210 into the male housing 200. The insertion portion 212 is inserted into and engaged with the male housing 200.

The outer lead portion 213 extends out of a rear end of the male housing 200. The outer lead portion 213 includes at a free end thereof a connection portion 213*a* through which the outer lead portion 213 is soldered with a metal pad acting as a signal terminal of a printed wiring board.

The male connector terminal 210 is fabricated by punching a single metal sheet in which the first and second projections 214*a* and 214*b* have been formed by pressing the first and second contact surfaces 211*a* and 211*b* of the tab portion 211, into a shape of the male connector terminal 210, and bending the outer lead portion 213 to thereby define the connection portion 213*a*. Since the first and second projections 214*a* and 214*b* have been already formed by pressing the first and second contact surfaces 211*a* and 211*b* of the tab portion 211, the first and second projections 214*a* and 214*b* can be formed more readily than carrying out a process of cutting a single metal sheet into the male connector terminal 210. The first and second projections 214*a* and 214*b* may be formed by cutting the first and second contact surfaces 211*a* and 211*b* of the tab portion 211, and the tab portion 211 and the first and second projections 214*a* and 214*b* may be formed by a drawing process or an extruding process, in which case, however, a pressing step is necessary to be carried out for forming the insertion portion 212 and the outer lead portion 213, resulting in that a process of fabricating the male connector terminal 210 is unavoidably complicated. Accordingly, it is necessary to form the first and second projections 214*a* and 214*b* by a pressing process.

Figure 7:
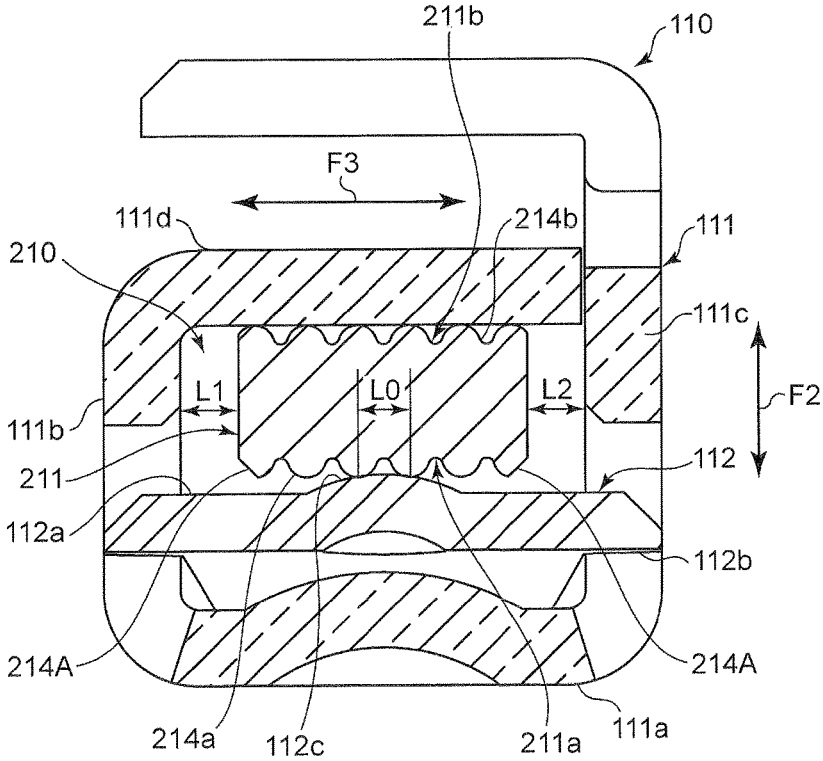
FIG. 7 is a cross-sectional view showing a positional relation between the male and female connector terminals, in which the certain area of the male connector terminal is located on a center of the flat spring.

As illustrated in FIG. 7, the first projections 214*a* located at opposite ends among the first projections 214*a* formed on the first contact surface 211*a* at which the tab portion 211 makes contact with the flat spring 112 are chamfered, that is, have an inclined surface 214A continuous to an arcuate surface.

When a metal sheet is cut in a direction to the first contact surface 211*a* from the second contact surface 211*b*, burr are generated on outer surfaces of the first projections 214*a* located at opposite ends among the first projections 214*a* formed on the first contact surface 211*a*. The inclined surfaces 214A are formed by compressing and collapsing the burr.

The connector terminal in accordance with the first embodiment, having the structure as mentioned above, is used in such a way as mentioned hereinbelow.

Figure 4:
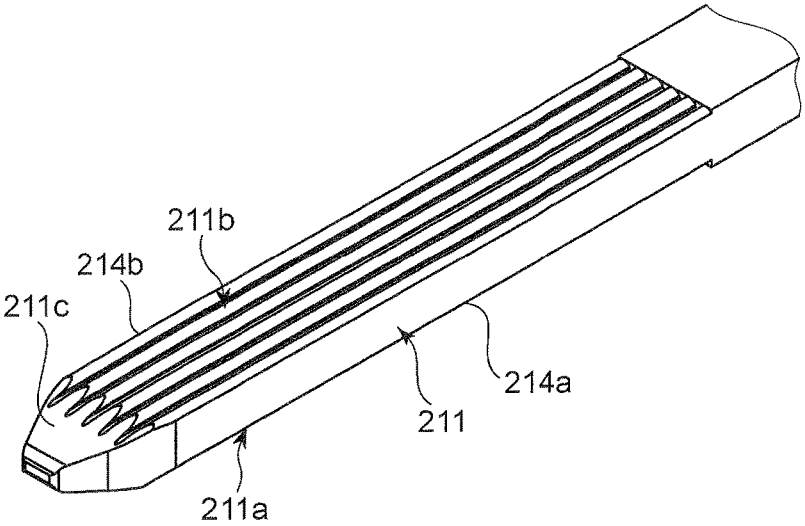
FIG. 4 is an enlarged perspective view of the male connector terminal of the male electric connector illustrated in FIG. 1.

As illustrated in FIG. 4, the male connector terminal 210 is caused to be located in front of the female connector terminal 110, and then, the female housing 100 of the female electric connector C1 is inserted into the space 201 formed in the male housing 200 of the male electric connector C2.

The sidewalls 111*b* and 111*c* of the sheath portion 111 are formed with the projections 111*h* (see FIG. 2). Accordingly, if the tab portion 211 is attempted to be inserted into the sheath portion 111 with a longitudinal line of the tab portion 211 being inclined relative to a longitudinal line of the sheath portion 111 when the tab portion 211 of the male connector terminal 210 is inserted into the sheath portion 111 of the female connector terminal 110, the posture of the tab portion 211 inserted into the sheath portion 111 is corrected such that the tab portion 211 is disposed within a width of the flat spring 112.

As illustrated in FIG. 5, when the male connector terminal 210 advances relative to the female connector terminal 110, and accordingly, the tab portion 211 is inserted into the sheath portion 111, the tab portion 211 of the male connector terminal 210 makes first contact at the tapered portion 211*c* located at a distal end thereof with the flat spring 112.

When the male connector terminal 210 further advances, the tab portion 211 can be caused to make contact with the expanded portion 211*c* acting as a contact surface relative to the flat spring 112, because the flat spring 112 is formed arcuate, and hence, the expanded portion 112*c* is formed in the central area 112*m*.

Figure 6:
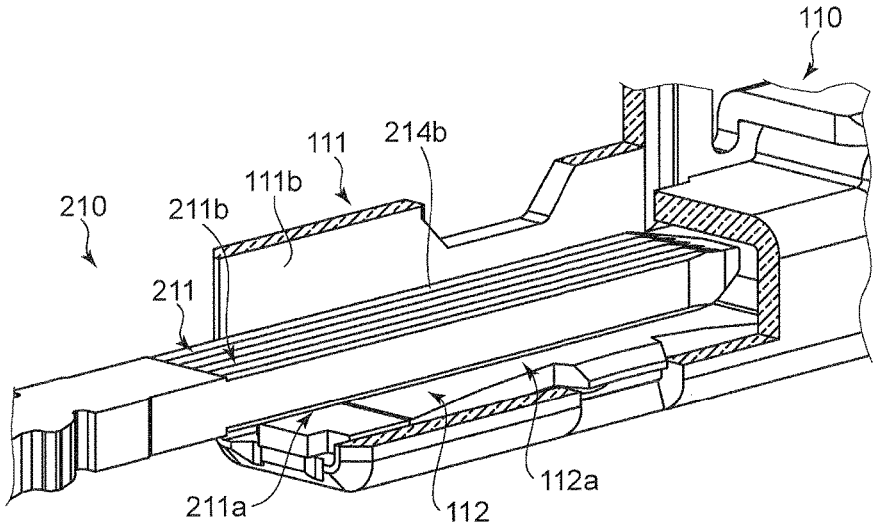
FIG. 6 is a perspective view with a portion of a sheath portion being cut, illustrating that the male connector terminal is inserted further into a sheath portion of the female connector terminal.

After the tab portion 211 made contact with the expanded portion 112*c*, the spring body 112*a* of the flat spring 112 is resiliently deformed due to a pressure generated by the tab portion 211 inserted into the sheath portion 111. As illustrated in FIG. 6, the tab portion 211 slides on the expanded portion 112*c* at the first contact surface 211*a*, and further slides on the ceiling portion 111*d* of the sheath portion 111 at the second contact surface 211*b* during the tab portion 211 is inserted deeply into the sheath portion 111.

Even if a force, which is generated when the flat spring 112 resiliently returns to its initial posture, acts on the first contact surface 211*a* of the tab portion 211, since the first projections 214*a* are formed on the first contact surface 211*a*, the tab portion 211 is able to make contact with the flat spring 112 in a smaller area than an area in which the first contact surface 211*a* makes contact with the flat spring 112 in the case that the first contact surface 211*a* would be a flat surface. Thus, the first projections 214*a* can reduce a force with which the tab portion 211 is inserted into and pulled out of the sheath portion 111. Furthermore, since the first projections 214*a* are designed to have an arcuate cross-section, the first projections 214*a* would not damage the flat spring 112 when the tab portion 211 is inserted into the female connector terminal 110.

As illustrated in FIG. 7, since the flat spring 112 includes the expanded portion 112*c* to make contact with the tab portion 211, the first projections 214*a* make contact with the expanded portion 112*c*. The expanded portion 112*c* makes contact not with all of the first projections 214*a* arranged in the width-wise direction F3, but with two first projections 214*a* among the six first projections 214*a*. Thus, when the tab portion 211 makes contact with the expanded portion 112*c*, the tab portion 211 is able to make contact with the expanded portion 112*c* through the smaller number of the first projections 214*a* than the number of the first projections 214*a* through which the tab portion 211 makes contact with the flat spring 112 in the case that the flat spring 112 is designed not to include the expanded portion 112*c*. Thus, it is possible to keep the tab portion 211 in stable contact with the flat spring 112, and to reduce a force with which the tab portion 211 is inserted into and pulled out of the sheath portion 111. Furthermore, the expanded portion 112*c* is designed longer in the direction F1 than in the width-wise direction F3 of the flat spring 112. Thus, the tab portion 211 is able to make stable contact with the flat spring 112 through the two first projections 214*a* without causing the first contact surface 211*a* of the tab portion 211 to incline relative to a plane at which the tab portion 211 makes contact with the expanded portion 112*c*.

The tab portion 211 further makes contact at the second contact surface 112*b* with the ceiling portion 111*d* of the sheath portion 111. Thus, since the tab portion 211 makes contact not only with the flat spring 112*d*, but also with the ceiling portion 111*d*, the tab portion 211 is able to make contact with the female connector terminal 110 in an increased contact area.

The second projections 214*b* are formed also on the second contact surface 211*b* of the tab portion 211. Accordingly, the tab portion 211 is able to make contact with the ceiling portion 111*d* of the sheath portion 111 in a smaller area than an area in which the tab portion 211 makes contact with the ceiling portion 111*d* in the case that the second contact surface 211*b* would be a flat surface.

Thus, since the tab portion 211 makes contact not only with the flat spring 112, but also with the ceiling portion 111, it is possible to enhance reliability to the contact of the tab portion 211 with the flat spring 112 and the sheath portion 111. Furthermore, since the second projections 214*b* formed on the second contact surface 211*b* is able to reduce friction to be generated between the tab portion 211 and the ceiling portion 111*d*, it is possible to reduce a force with which the tab portion 211 is inserted into and pulled out of the sheath portion 111.

In a positional relation between the female connector terminal 110 and the male connector terminal 210 both illustrated in FIG. 7, the tab portion 211 of the male connector terminal 210 is located centrally of the flat spring 112 of the female connector terminal 110 in the width-wise direction F3. Since the tab portion 211 is located centrally of the flat spring 112, the expanded portion 112*c* makes contact with the two first projections 214*a* disposed centrally of the tab portion 211.

As illustrated in FIG. 1, the sheath portion 111 of the male connector terminal 110 is housed in the terminal space 101*a* of the female housing 100, engaged with the lance 101*b*. Accordingly, the female connector terminal 110 may move in the terminal space 101*a*, for instance, when a cable fixed in the bundling section 113 is pulled.

Furthermore, a positional relation between the female connector terminal 110 of the female housing 100 and the male connector terminal 210 of the male housing 200 may be deviated due to tolerance of them.

As illustrated in FIG. 7, even if a positional relation between the tab portion 211 and the sheath portion 111 were shifted in the thickness-wise direction F2 of the tab portion 211 extending perpendicularly to the first and second contact surfaces 211*a* and 211*b*, the tab portion 211 is sandwiched between the flat spring 112 and the ceiling portion 111*d*, and hence, the first projections 214*a* are kept in contact with the flat spring 112.

Figure 8:
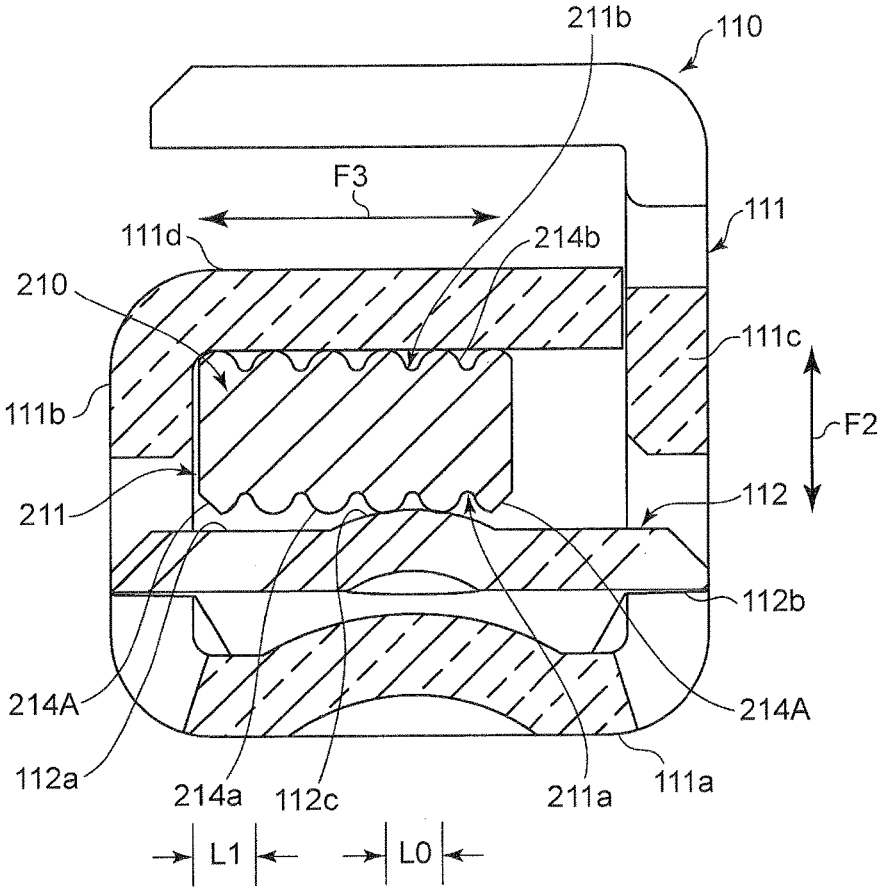
FIG. 8 is a cross-sectional view showing a positional relation between the male and female connector terminals, in which the certain area of the male connector terminal is deviated to an end of the flat spring in a width-wise direction thereof.

It is supposed that the tab portion 211 is moved to one of sides in the sheath portion 111 in the width-wise direction F3 of the flat spring 112 extending in parallel with the first and second contact surfaces 211*a* and 211*b* and perpendicularly to the direction F1. For instance, as illustrated in FIG. 8, it is supposed that the tab portion 211 is moved to the left relative to the center of the flat spring 112.

In the first embodiment, a distance L0 between adjacent first and second projections 214*a* and 214*b* is designed to be almost equal to a distance L1 defined as a distance allowed for the tab portion 211 to be deviated between a position in which the tab portion 211 is located centrally of the flat spring 112 and a position in which the tab portion 211 makes contact with the left sidewall 111*b*. As an alternative, the distance L1 may be defined as a distance between the left sidewall 111*b* and a left side of the tab portion 211 when the tab portion 211 is disposed in the position illustrated in FIG. 7.

Thus, the tab portion 211 is designed to have such a width that two or more first projections 214*a* among the first projections 214*a*, located close to the right sidewall 111*c* of the sheath portion 111 when the tab portion 211 makes contact with the left sidewall 111*b* of the sheath portion 111, makes contact with the expanded portions 112*c*. Herein, a width of the tab portion 211 means a length measured along a plane defined by the first contact surface 211*a* extending perpendicularly to the direction F1 (see FIG. 3) in which the tab portion 211 is inserted into and pulled out of the sheath portion 111.

Since the two first projections 214*a* are kept in contact with the expanded portion 112*c* of the flat spring 112, the tab portion 211 can be kept in stable contact with the flat spring 112.

Figure 9:
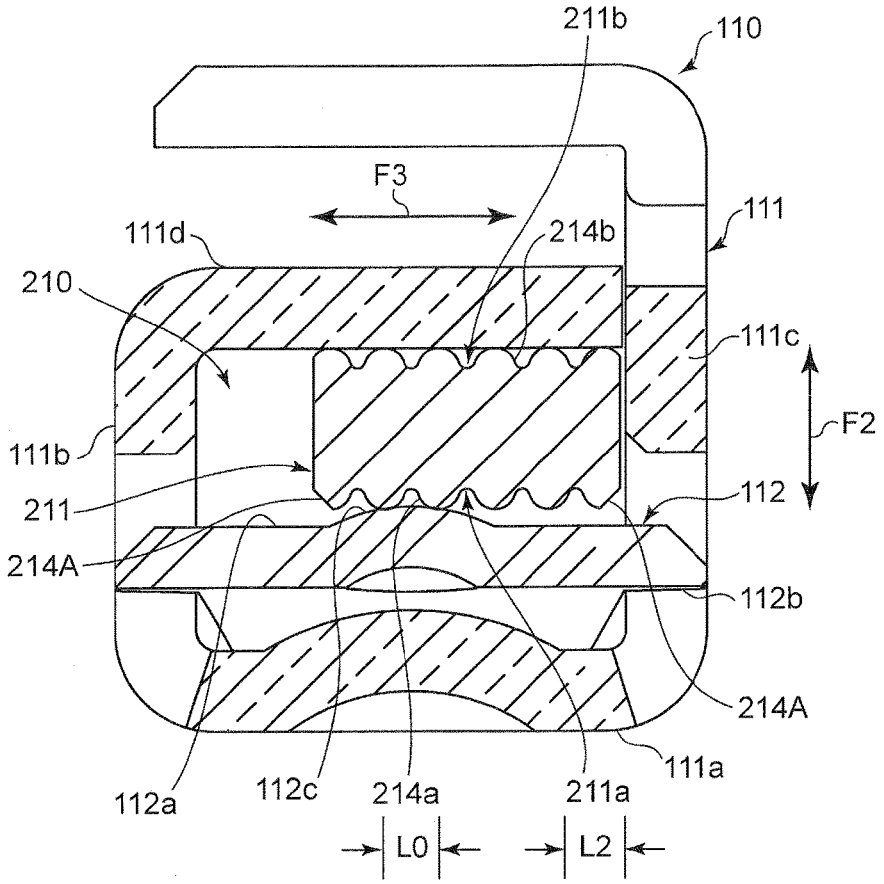
FIG. 9 is a cross-sectional view showing a positional relation between the male and female connector terminals, in which the certain area of the male connector terminal is deviated to the other end of the flat spring in a width-wise direction thereof.

It is supposed that the tab portion 211 is moved to the other side in the sheath portion 111 in the width-wise direction F3, contrary to the case illustrated in FIG. 8. Specifically, as illustrated in FIG. 9, it is supposed that the tab portion 211 is moved to the right relative to the center of the flat spring 112.

A distance L0 between adjacent first and second projections 214*a* and 214*b* is designed to be almost equal to a distance L2 defined as a distance allowed for the tab portion 211 to be deviated between a position in which the tab portion 211 is located centrally of the flat spring 112 and a position in which the tab portion 211 makes contact with the right sidewall 111*c*. As an alternative, the distance L2 may be defined as a distance between the right sidewall 111*c* and a right side of the tab portion 211 when the tab portion 211 is disposed in the position illustrated in FIG. 7.

Thus, two or more two first projections 214*a* among the first projections 214*a*, located close to the left sidewall 111*d* of the sheath portion 111 when the tab portion 211 makes contact with the right sidewall 111*c* of the sheath portion 111, makes contact with the expanded portions 112*c*.

As mentioned above, even if the tab portion 211 moves between the sidewalls 111*b* and 111*c* of the sheath portion 111 in the width-wise direction of the flat spring 112, the two first projections 214*a* are kept in contact with the flat spring 112, ensuring that the tab portion 211 can be kept in stable contact with the flat spring 112. Accordingly, the connector terminal in accordance with the first embodiment is able to reduce a force necessary for fitting the female and male connector terminals 110 and 210 into each other and releasing those out of each other, and enhance reliability to the contact therebetween.

By collapsing burr generated at outer surfaces of the first projections 214*a* located at opposite ends on the first contact surface 211*a* to thereby define the inclined surfaces 214A, when the tab portion 211 moves in the width-wise direction of the flat spring 112, it is possible to prevent the expanded, portion 112*c* from being hooked by the burr to thereby allow the tab portion 211 to move without being interfered. Furthermore, by collapsing the burr to thereby define the inclined surfaces 214A, it is possible to prevent the expanded portion 112*c* from being damaged by the burr.

In the first embodiment, the first projections 214*a* on which burr are generated are designed to be disposed without a range in which the tab portion 211 moves in the sheath portion 111 in the width-wise direction of the flat spring 112. Thus, even if burr remain without being removed on the first projections 214*a*, it is surely possible to prevent the expanded portion 112*c* from being damaged by the burr, because the first projections 214*a* located at opposite ends on the first contact surface 214*a* do not make contact with the expanded portion 112*c*.

[Second Embodiment]

The connector terminal in accordance with a second embodiment of the present invention is explained hereinbelow with reference to FIGS. 10 to 14. Parts or elements that correspond to those of the first embodiment illustrated in FIGS. 5 to 9 have been provided with the same reference numerals, and operate in the same manner as corresponding parts or elements in the first embodiment, unless explicitly explained hereinbelow.

Figure 10:
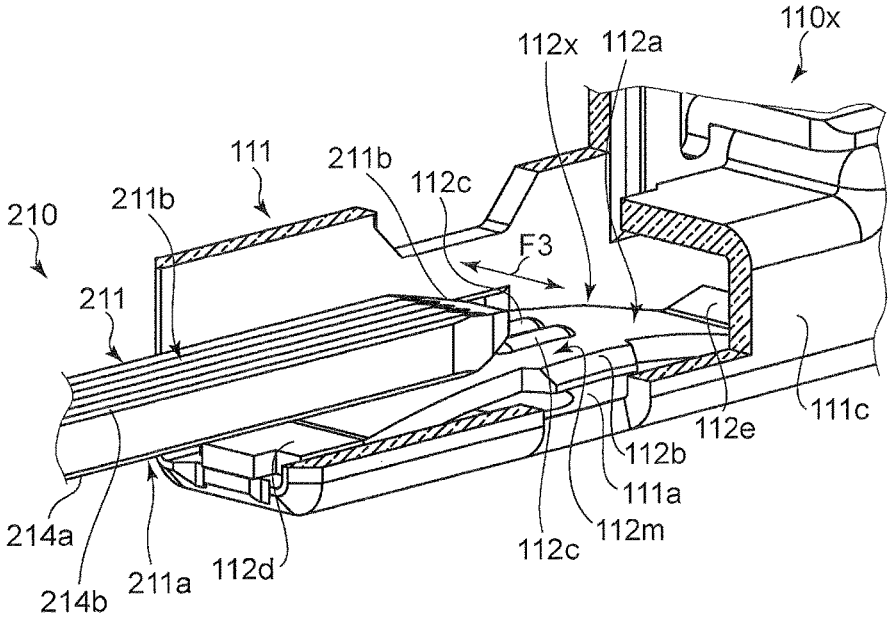
FIG. 10 is a perspective view with a portion of a sheath portion being cut, illustrating that the male connector terminal makes contact at the certain area with a plurality of expanded portions of the flat spring when the male connector terminal is inserted into a sheath portion of the female connector terminal.

A female connector terminal 110*x* illustrated in FIG. 10 includes a flat spring 112*x* on which a plurality of expanded portions 112*c* are formed. The expanded portions 112*c* are arranged in the width-wise direction F3 of the flat spring 112*x*. The connector terminal in accordance with the second embodiment is designed to include two expanded portions 112*c*.

When the male connector terminal 210 is inserted into the female connector terminal 110, similarly to the first embodiment, the male connector terminal 210 makes first contact at the tapered portion 211*c* of the tab portion 211 with the two expanded portions 112*c* of the flat spring 112*x*.

Figure 11:
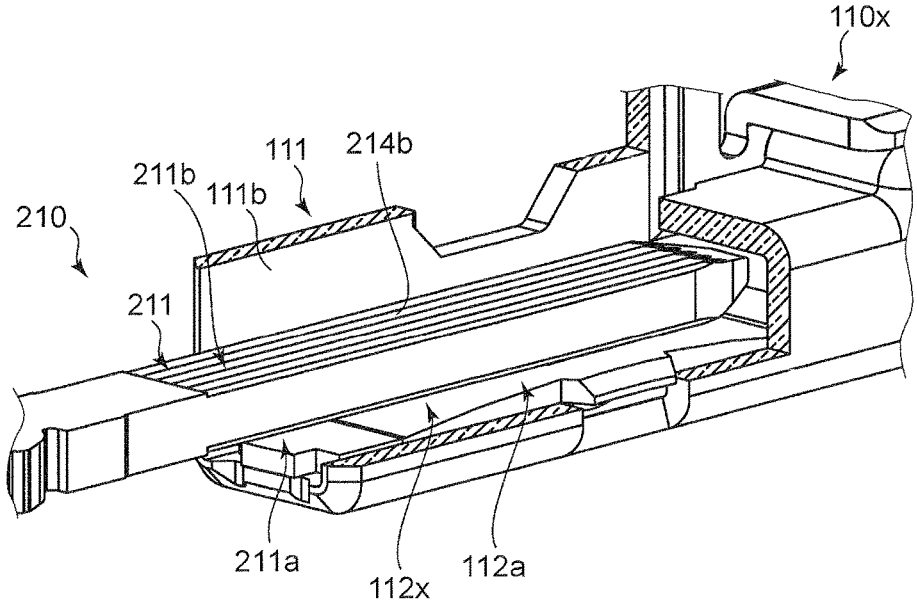
FIG. 11 is a perspective view with a portion of a sheath portion being cut, illustrating that the male connector terminal is inserted further into a sheath portion of the female connector terminal.

After the tab portion 211 made contact with the expanded portion 112*c*, a spring body 112*a* of the flat spring 112*x* is resiliently deformed due to a pressure generated by the tab portion 211 inserted into the sheath portion ill. The tab portion 211 slides on the expanded portions 112*c* at the first contact surface 211*a*, and further slides on the ceiling portion 111*d* of the sheath portion 111 at the second contact surface 211*b* during the tab portion 211 is inserted deeply into the sheath portion 111, as illustrated in FIG. 11.

Since the flat spring 112*c* is formed with a plurality of the expanded portions 112*c*, a contact area through which the flat spring 112*x* makes contact with the tap portion 211 is greater than the same in the first embodiment. However, since each of the two expanded portions 112*c* formed on the flat spring 112*x* with a gap being therebetween supports two first projections 214*a* among the first projections 214*a*, it is possible to keep the tab portion 211 in stable contact with the flat spring 112*x*.

Figure 12:
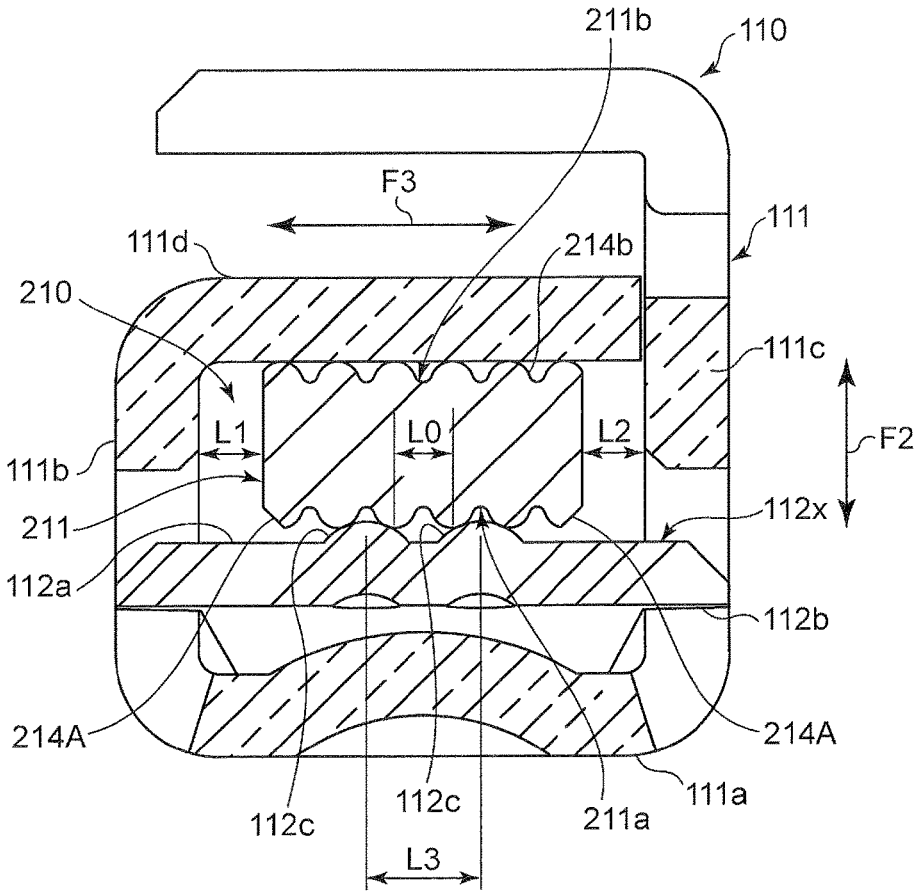
FIG. 12 is a cross-sectional view showing a positional relation between the male and female connector terminals, in which the certain area of the male connector terminal is located on a center of the flat spring.
Figure 13:
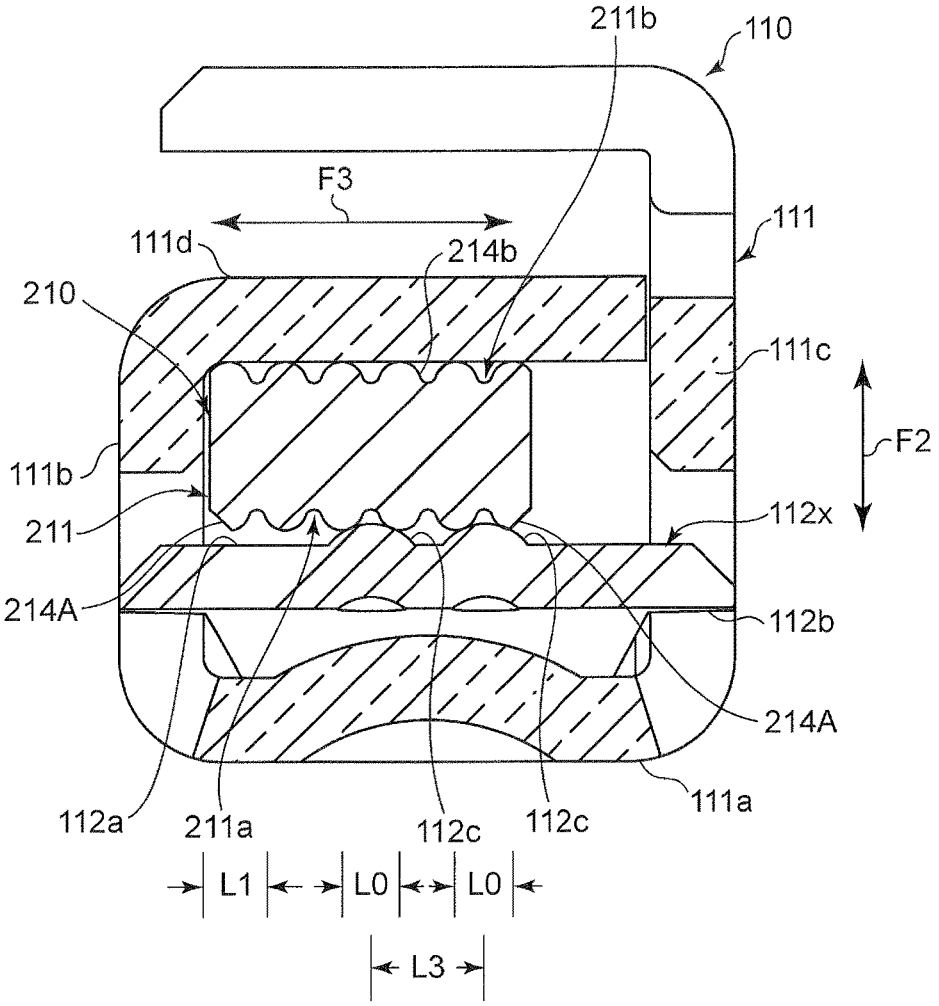
FIG. 13 is a cross-sectional view showing a positional relation between the male and female connector terminals, in which the certain area of the male connector terminal is deviated to an end of the flat spring in a width-wise direction thereof.
Figure 14:
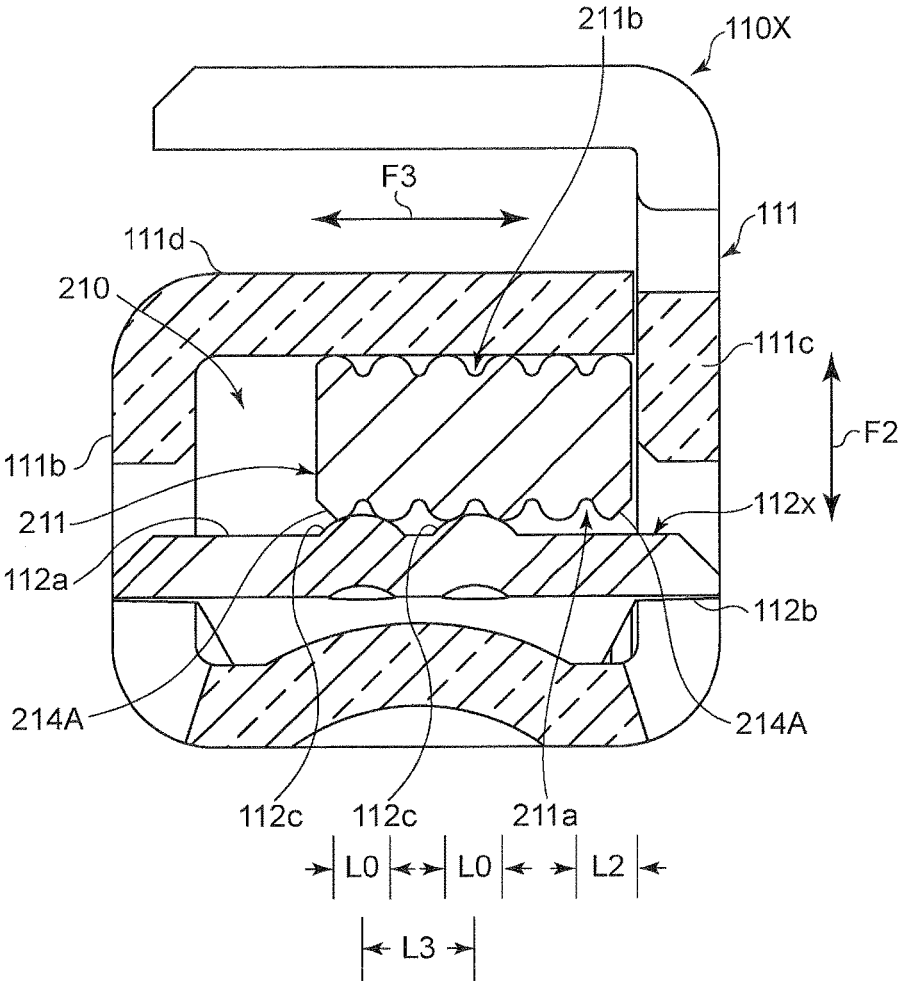
FIG. 14 is a cross-sectional view showing a positional relation between the male and female connector terminals, in which the certain area of the male connector terminal is deviated to the other end of the flat spring in a width-wise direction thereof.
Figure 15:
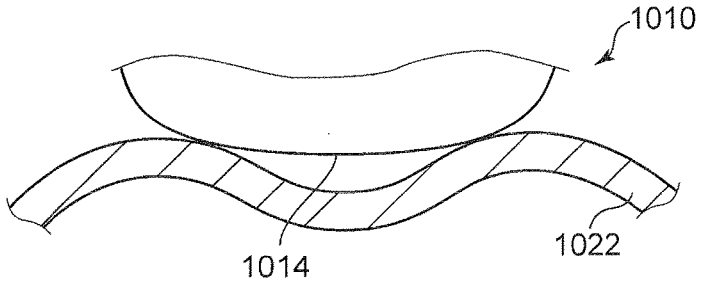
FIG. 15 illustrates a part of the conventional connector.

In the second embodiment, as illustrated in FIGS. 12 and 13, a distance L0 between adjacent first and second projections 214*a* and 214*b* is designed to be almost equal to distances L1 and L2 each defined as a distance allowed for the tab portion 211 to be deviated between a position in which the tab portion 211 is located centrally of the flat spring 112*x* and a position in which the tab portion 211 makes contact with the left and right sidewalls 111*b* and 111*c*. As an alternative, the distance L1 may be defined as a distance between the left sidewall 111*b* and a left side of the tab portion 211 when the tab portion 211 is disposed in the position illustrated in FIG. 12, and the distance L2 may be defined as a distance between the right sidewall 111*c* and a right side of the tab portion 211 when the tab portion 211 is disposed in the position illustrated in FIG. 12.

A distance L3 between the two expanded portions 112*d* is designed to be almost equal to L0×2, i.e., the double of the distance L0.

Thus, even if the tab portion 211 moves in the sheath portion 111 in the width-wise direction F3 of the flat spring 112*x*, two first projections 214*a* among the six first projections 214*a*, disposed closer to the right or left sidewall 111*c* or 111*b*, make contact with the corresponding expanded portion 112*c* with the tab portion 211 making contact with the left or right sidewall 111*b* or 111*c*, respectively.

Thus, since the two first projections 214*a* are kept in contact with the flat spring 112*x* between the left and right sidewalls 111*b* and 111*c* of the sheath portion 111, the tab portion 211 can be kept in stable contact with the flat spring 112*x*. Furthermore, since each of the expanded portions 112*c* makes contact with the two first projections 214*a*, the tab portion 211 can be kept in further stable contact with the expanded portions 112*c*.

In the second embodiment, the flat spring 112*x* is designed to include the two expanded portions 112*c*, and both of the expanded portions 112*c* make contact with the first projections 214*a*, even if the tab portion 211 displaces in the width-wise direction F3. Since it is necessary for at least two first projections 214*a* among the first projections 214*s* to make contact with at least one of the expanded portions 112*c*, for instance when the tab portion 211 moves to the left sidewall 111*b*, the first projections 214*a* may contact with one of the expanded portions 112*c* disposed closer to the left sidewall 111*b*, in which case, the first projections 214*a* does not make contact with the other expanded portion 112*c* disposed closer to the right sidewall 111*c*, and vice versa.

Since the totally four first projections 214*a* make contact with the two expanded portions 112*c*, specifically, the two first projections 214*a* make contact with each of the two expanded portions 112*c* in the sheath portion 111, it is possible to enhance stability to the contact between the tab portion 211 and the flat spring 112*x*.

In the second embodiment, the flat spring 112*x* is designed to be formed with the two expanded portions 112*c*. It should be noted that the flat spring 112*x* may be formed three or more expanded portions 112*c* at the spring body 112*a* in view of a magnitude of a force necessary for inserting the tab portion 211 into and pulling the tab portion 211 out of the sheath portion 111, and reliability to the contact of the tab portion 211 to the expanded portions 112*c*.

Each of the expanded portions 112*c* is designed to be longer in a longitudinal direction, that is, a direction in parallel with the direction F1 than in a width-wise direction, that is, a direction perpendicular to the direction F1. As an alternative, each of the expanded portions 112*c* may be designed to have a length in a longitudinal direction equal to a length in the width-wise direction F3 of the flat spring 112 or 112*x*, when viewed in a plane.

In the first and second embodiments, the tab portion 211 of the male connector terminal 210 is inserted into the sheath portion 111, as a female connector body, including the floor portion 111*a*, a pair of the sidewalls 111*b* and 111*c*, and the ceiling portion 111*d*. It should be noted that a female connector body may be defined only with a pair of the sidewalls 111*b* and 111*c*.

INDUSTRIAL APPLICABILITY

The connector terminal in accordance with the present invention is suitable to an electric connector to be used broadly in various fields such as an automobile industry, an electric/electronic device industry, and other mechanical industries, as a connector for connecting wires to each other to transfer electric signals therethrough.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-191627 filed on Sep. 19, 2014 including specification, claims, drawings and summary is incorporated herein by reference in its entirety.

What is claimed is:

1. A connector terminal including a first connector terminal and a second connector terminal to be fit into said first connector terminal, said first connector terminal including:

a flat spring making contact with a certain area of said second connector terminal, said certain area including a free end of said second connector terminal; and a terminal body including a pair of sidewalls between which said flat spring is disposed, said second connector terminal having a rectangular cross-section, said second connector terminal including three or more first projections in said certain area on one of two surfaces thereof facing each other, said three or more first projections each extending in a first direction in which said second connector terminal is fit into said first connector terminal, at least two first projections among said three or more first projections making contact with said flat spring between said sidewalls.

2. The connector terminal as set forth in claim 1, wherein said terminal body includes a ceiling portion and a floor portion each connecting said sidewalls to each other, said second connector terminal including in said certain area at least one second projection making contact with said ceiling portion and extending in said first direction, said second projection being formed on the other surface of said two surfaces.

3. The connector terminal as set forth in claim 1, wherein each of said first projections has an arcuate cross-section in a direction perpendicular to said first direction.

4. The connector terminal as set forth in claim 1, wherein said first projections are formed by pressing.

5. The connector terminal as set forth in claim 1, wherein a distance between said at least two first projections is equal to a distance between said certain area and one of said sidewalls, the latter distance being to be measured when said certain area is disposed at a center of said flat spring.

6. The connector terminal as set forth in claim 1, wherein a distance between said three or more first projections located adjacent to each other being equal to each other.

7. The connector terminal as set forth in claim 1, wherein each of said three or more first projections disposed at opposite ends in a width-wise direction of said second connector terminal has an inclined surface facing outwardly.

8. The connector terminal as set forth in claim 1, wherein said three or more first projections disposed at opposite ends in a width-wise direction of said second connector terminal are arranged to be located not to make contact with said flat spring even if said second connector terminal moves relative to said flat spring in a width-wise direction thereof.

9. The connector terminal as set forth in claim 1, wherein said flat spring includes an expanded portion making contact with said at least two first projections.

10. The connector terminal as set forth in claim 9, wherein said flat spring includes a central area expanding in an arcuate form, said expanded portion being formed in said central area.

11. The connector terminal as set forth in claim 9, wherein said flat spring includes a plurality of expanded portions making contact with said at least two first projections, said expanded portions being arranged in a width-wise direction of said flat spring.

12. The connector terminal as set forth in claim 11, wherein each of said expanded portions makes contact with said at least two first projections.

13. The connector terminal as set forth in claim 12, wherein a distance between said at least two first projections is equal to both a distance between said certain area and one of said sidewalls and a distance between said certain area and the other of said sidewalls, the last two distances being to be measured when said certain area is disposed at a center of said flat spring.

* * * * *